US008657564B2

(12) United States Patent
Cuppetelli

(10) Patent No.: US 8,657,564 B2
(45) Date of Patent: Feb. 25, 2014

(54) CENTRIFUGAL CHOPPER PUMP

(71) Applicant: Walter James Cuppetelli, Clinton Township, MI (US)

(72) Inventor: Walter James Cuppetelli, Clinton Township, MI (US)

( * ) Notice: Subject to any disclaimer, the term of this patent is extended or adjusted under 35 U.S.C. 154(b) by 0 days.

(21) Appl. No.: 13/677,815

(22) Filed: Nov. 15, 2012

(65) Prior Publication Data

US 2013/0121811 A1 May 16, 2013

Related U.S. Application Data

(60) Provisional application No. 61/560,340, filed on Nov. 16, 2011.

(51) Int. Cl.
*F04D 7/02* (2006.01)

(52) U.S. Cl.
USPC ..... 415/121.1

(58) Field of Classification Search
USPC ..... 415/121.1, 121.3, 126, 151; 417/900
See application file for complete search history.

(56) References Cited

U.S. PATENT DOCUMENTS

| | | | | |
|---|---|---|---|---|
| 3,128,051 | A * | 4/1964 | Smith | 415/121.1 |
| 3,417,929 | A * | 12/1968 | Secrest | 241/46.04 |
| 4,402,648 | A * | 9/1983 | Kretschmer | 415/121.1 |
| 4,778,336 | A * | 10/1988 | Husain | 415/121.1 |
| 5,456,580 | A | 10/1995 | Dorsch | |
| 5,460,483 | A | 10/1995 | Dorsch | |
| 6,224,331 | B1 | 5/2001 | Hayward et al. | |
| 7,159,806 | B1 * | 1/2007 | Ritsema | 241/46.06 |
| 7,811,051 | B2 | 10/2010 | Wagner | |
| 7,841,550 | B1 | 11/2010 | Dorsch et al. | |
| 2004/0234370 | A1 * | 11/2004 | Simakaski et al. | 415/121.1 |
| 2008/0008577 | A1 * | 1/2008 | Cohen | 415/121.1 |
| 2009/0067992 | A1 * | 3/2009 | Keener | 415/121.1 |
| 2009/0232639 | A1 * | 9/2009 | Arnold et al. | 415/121.1 |

FOREIGN PATENT DOCUMENTS

| | | | |
|---|---|---|---|
| JP | 61-226260 | * | 10/1986 |
| JP | 5-99185 | * | 4/1993 |
| KR | 100950454 B1 | | 4/2010 |

OTHER PUBLICATIONS

Nakamura, Dresing device in grinding machine, Oct. 8, 1986, Abstract of JP61-226260.*

Sakakibara, Submerged pump with cutter for sewage pipe, Apr. 20, 1993, Abstract of JP5-99185.*

Vaughan, Chopper Pumps, www.chopperpumps.com, printed Oct. 27, 2011.

Kim, Jin Ho, International Search Report and Written Opinion for PCT Application No. PCT/US2012/065210 dated Feb. 27, 2013, 11 pages WIPO, Republic of Korea.

* cited by examiner

*Primary Examiner* — Edward Look
*Assistant Examiner* — Liam McDowell
(74) *Attorney, Agent, or Firm* — Brooks Kushman P.C.

(57) ABSTRACT

A chopper pump is provided with a motor having a drive shaft and a casing connected to the motor and defining a bowl with an inlet for receiving waste material. A cover plate assembly is secured about the inlet. The cover plate assembly having a base with a central opening and a plurality of serrations formed into the base and spaced about the central opening, each serration being formed into a curved pocket and longitudinally tapered to form an edge on an inner surface of the base. The chopper pump also includes a cutter having a hub that is connected to the drive shaft. The cutter extends through the central opening of the base and includes at least two blades extending radially outward to guide waste material toward the plurality of serrations.

16 Claims, 6 Drawing Sheets

CENTRIFUGAL CHOPPER PUMP

CROSS-REFERENCE TO RELATED APPLICATIONS

This application claims the benefit of U.S. provisional Application No. 61/560,340 filed Nov. 16, 2011, the disclosure of which is incorporated in its entirety by reference herein.

TECHNICAL FIELD

One or more embodiments relate to a chopper pump for cutting and macerating solid material present in a liquid.

BACKGROUND

A chopper pump is a centrifugal pump, which is equipped with a cutting system to facilitate chopping/maceration of solids that are present in a pumped liquid. Chopper pumps generally include a motor and an impeller and a plurality of cutting surfaces. The motor provides torque and the impeller converts the torque into a centrifugal force acting upon the liquid. The cutting surfaces chop and macerate the solid material that is present within the liquid within the pump. The chopper pump is often used for pumping sewage, sludge, manure slurries, and other liquids that contain large or tough solids.

SUMMARY

In one embodiment a chopper pump is provided with a motor having a drive shaft and a casing connected to the motor and defining a bowl with an inlet for receiving waste material. A cover plate assembly is secured about the inlet. The cover plate assembly having a base with a central opening and a plurality of serrations formed into the base and spaced about the central opening, each serration being formed into a curved pocket and longitudinally tapered to form an edge on an inner surface of the base. The chopper pump also includes a cutter that is connected to the drive shaft and extends through the central opening of the base. The cutter includes at least two blades that extend radially outward to guide waste material toward the plurality of serrations.

In another embodiment a chopper pump is provided with a motor having a drive shaft. A casing is connected to the motor and defines a bowl with an inlet for receiving waste material. An impeller is connected to the drive shaft and includes at least two vanes that are configured to provide an outward force upon the waste material. A cover plate assembly is secured about the inlet and includes a base with at least two grooves formed into an inner surface of the base and oriented adjacent to the vanes. The grooves provide a stationary cutting surface for waste material forced outward by the impeller.

In yet another embodiment, a chopper pump is provided with a motor having a drive shaft and a casing connected to the motor. The casing defines a bowl with an inlet for receiving waste material. A cover plate assembly is secured about the inlet, and includes a base with a wall extending transversely from the base and at least two mounting blocks extending radially inward from the wall. Each mounting block having a stationary blade mounted thereon. The chopper pump also includes a cutter having a hub connected to the drive shaft and at least two curved blades extending radially outward from the hub. The curved blades are tapered to guide waste material radially outward from the drive shaft toward each stationary blade.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
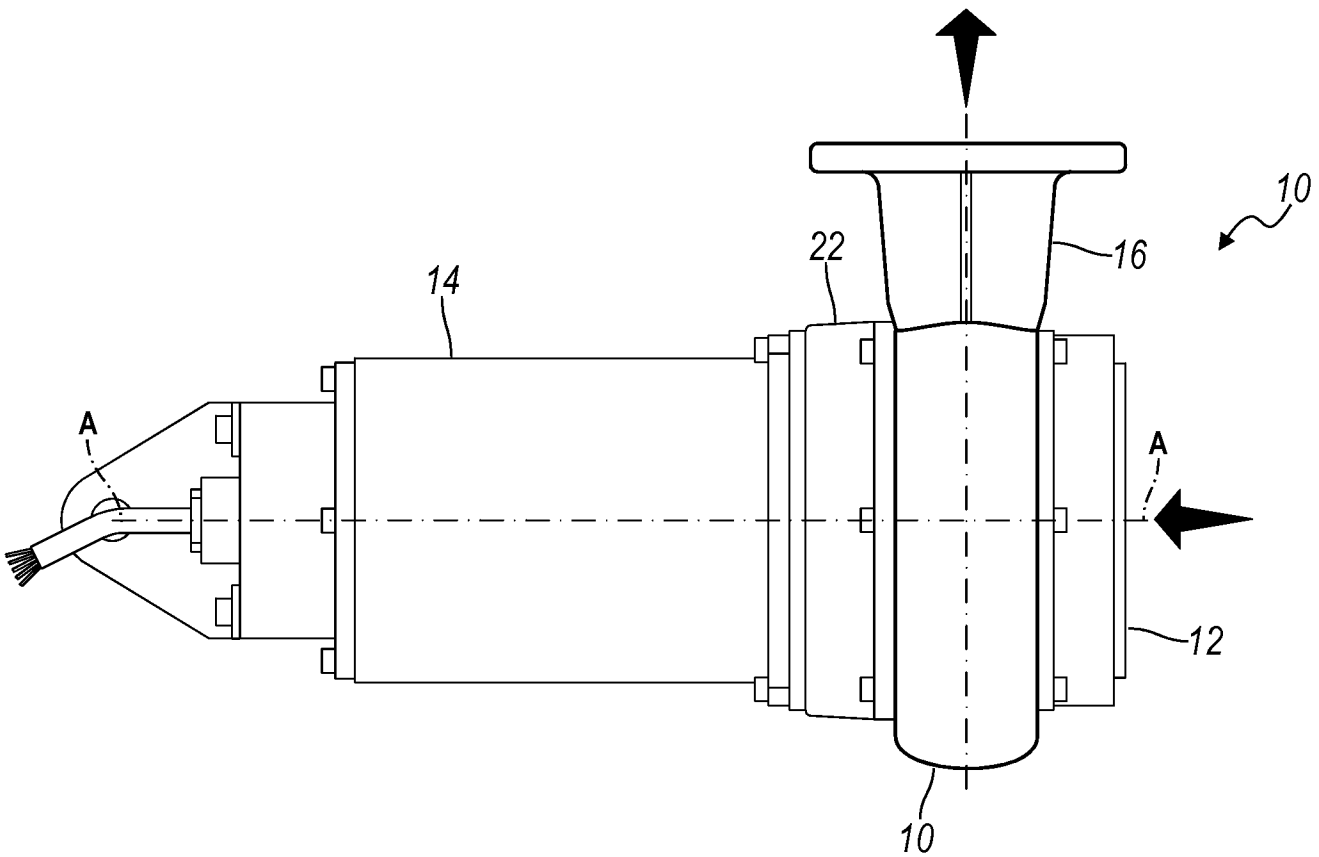
FIG. 1 is a front elevation view of a chopper pump according to at least one embodiment and illustrated with a motor and a bearing housing.

With reference to FIG. 1, a chopper pump for cutting and macerating a waste material, which may be solids present within a fluid, is illustrated according to at least one embodiment and is generally referenced by numeral 10. The chopper pump 10 includes an inlet 12 for receiving the waste material, which may be waste fluid containing solid material. The pump 10 is operated by a motor 14 which rotates cutting mechanisms (shown in FIG. 2) within the pump for cutting and macerating the waste fluid into a thick slurry. The motor 14 also rotates an impeller (shown in FIG. 2) within the pump 10 which creates a centrifugal force which acts upon the slurry to force, e.g., pump, the slurry through an outlet tube 16 of the pump 10. The chopper pump 10 may be used in a variety of applications such as sewage treatment sites, food processing plants, paper mills and farms.

Figure 2:
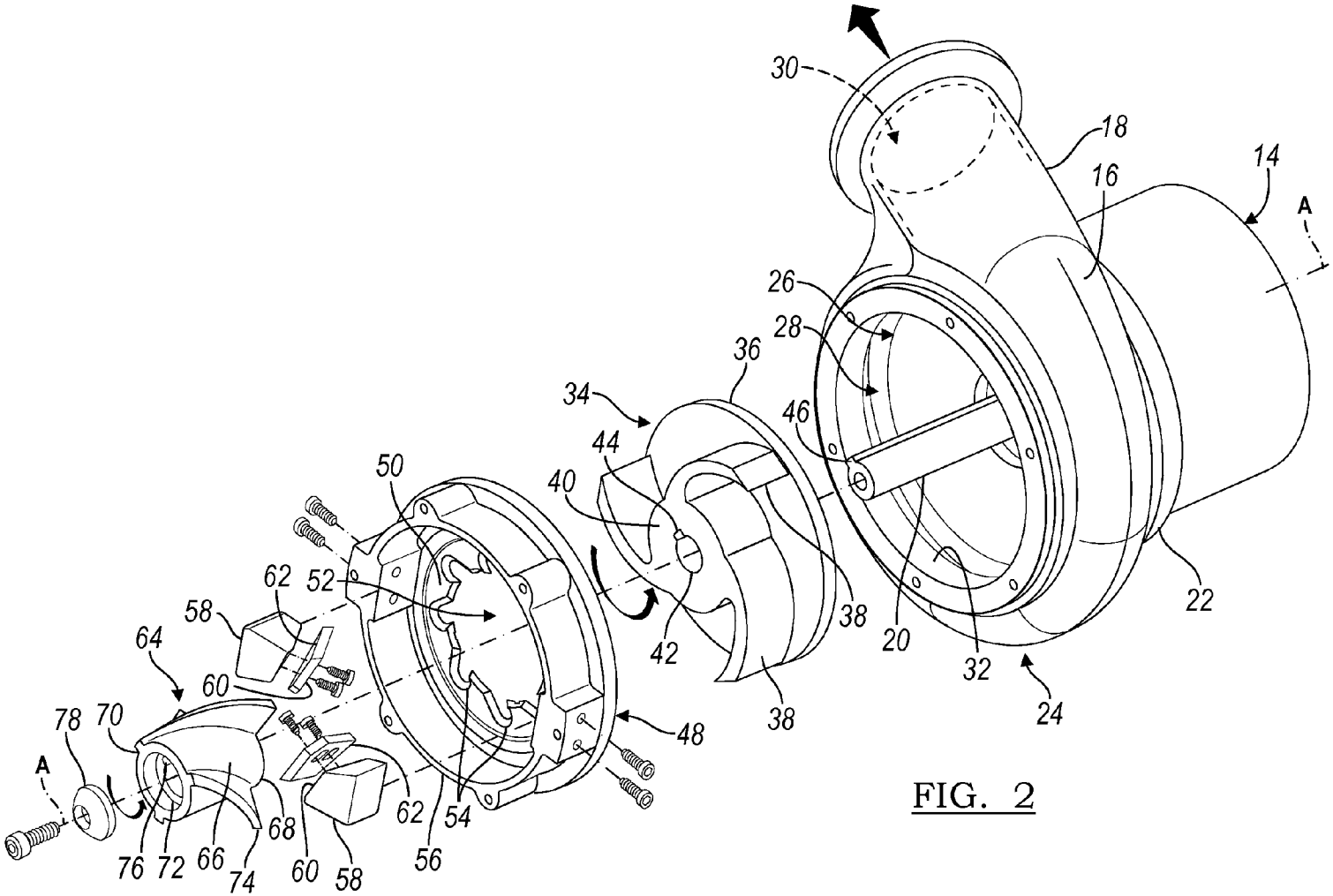
FIG. 2 is an exploded side perspective view of the chopper pump of FIG. 1.

Referring to FIGS. 1 and 2, the motor 14 provides output torque for operating the pump 10. The motor 14 includes a housing 18 and a drive shaft 20 extending from the housing 18. The drive shaft 20 extends along a longitudinal axis generally referenced as A-A. A bearing housing 22 interconnects the motor housing 18 and the pump 10. The bearing housing 22 includes bearings (not shown) for supporting the shaft 20. The bearing housing 22 also includes a seal assembly (not shown) to prevent waste fluid from entering the motor housing 18. The drive shaft 20 of the illustrated embodiment may extend from a rotor (not shown) of the motor, or may be indirectly coupled to the rotor through a gear train (not shown). In either case, the motor 14 provides mechanical rotational power (torque and angular speed) at the drive shaft 20. The motor 14 is a submersible electric motor rated at 3-25 HP, and operating at approximately 1750 rpm, according to at least one embodiment. Other embodiments of the motor 14 contemplate a hydraulic motor (not shown).

FIG. 2 is an exploded side perspective view of the chopper pump 10 to illustrate internal components. The pump 10 includes a casing 24 that is coupled to the motor housing 18. The bearing housing 22 interconnects the casing 24 and the motor housing 18. The casing 24 includes a bowl 26 and the outlet tube 16. The tube 16 extends tangentially from the bowl 26. The bowl 26 defines an inner cavity 28. A volute chamber 30 projects in a spiral direction about the circumference of the bowl 26 and through the outlet tube 16. A central aperture (not shown) is formed through the bowl 26 along the axis A-A for receiving the drive shaft 20. The bowl 26 also includes an open end 32 formed opposite the central aperture.

The pump 10 includes an impeller 34 for converting the motor torque into a centrifugal force acting upon the liquid slurry, to force the slurry outward and into the volute chamber 30. The impeller 34 is positioned within the bowl 26. The impeller 34 is formed in a semi-open configuration with a circular plate 36 and three vanes 38 according to one embodiment. The vanes 38 extend longitudinally from an outer surface of the circular plate 36. The vanes 38 collectively form a central hub 40; and extend outward in a generally radial direction toward an outer periphery of the circular plate 36. Other embodiments of the impeller 34 include two vanes or more than three vanes. The impeller 34 includes a central bore 42 that projects through the plate 36 and the hub 40 along axis A-A, for receiving the drive shaft 20. The impeller 34 may be formed as a unitary component. For example, the impeller may be formed as aluminum casting with high chromium content ("high-chromium casting") according to one embodiment.

The impeller 34 is secured to the drive shaft 20 by a key-keyway interface according to one embodiment. A keyway 44 is formed into an inner surface of the central hub 40, and extends longitudinally through the central bore 42. A key 46 extends radially outward from the drive shaft 20, and is received within the keyway 44 for securing the impeller 34 to the drive shaft 20. The key 46 may be formed in the drive shaft 20, or the drive shaft 20 may also include a keyway, where the key 46 is a separate component. Other embodiments of the pump 10 include alternative features for securing the impeller 34 to the drive shaft 20 (e.g, a spline).

The pump 10 includes a cover plate assembly 48 having a plurality of stationary cutting blades. The cover plate assembly 48 is secured about the open end 32 of the casing 24. The cover plate 48 includes a base 50 having with a central opening 52 for receiving the waste fluid. A number of serrations 54 are formed through the base 50. The serrations 54 act as stationary blades for cutting solid material as it passes through the central opening 52.

The cover plate assembly 48 includes a wall 56 that extends transversely from a circumferential edge of the base 50. Mounting blocks 58 are connected to an inner surface of the wall 56; and extend radially inward toward the central opening 52. Each mounting block 58 includes an inner face 60 that is oriented adjacent to the central opening 52. Other embodiments of the cover plate assembly 48 include integrally formed mounting blocks (not shown). For example the base 50, wall 56 and mounting blocks 58 may be formed as a single casting. A blade 62 is mounted upon the inner face 60 of each mounting block 58.

The pump 10 includes an external cutter 64, or auger, that provides a rotating cutting mechanism. The cutter 64 includes a cylindrical hub 66 with a first end 68 and a second end 70 that is opposite to the first end 68. An aperture 72 projects through the hub 66 for receiving the drive shaft 20. A plurality of helical blades 74 extend outward from the hub 66. The blades 74 are tapered such that a radial thickness of each blade 74 increases from the second end 70 to the first end 68 to form a generally frusto-conical shape. Such tapered blades 74 guide the waste material radially outward toward the blades 62 and the serrations 54. The external cutter 64 may be formed as a unitary component. For example, the cutter 64 may be formed as a hardened iron casting according to one embodiment.

The external cutter 64 is also secured to the drive shaft 20 by a key-keyway interface according to one embodiment. A keyway 76 is formed into an inner surface of the cylindrical hub 66, and extends longitudinally through the aperture 72. The key 46 extends radially outward from the drive shaft 20, and is received within the keyway 76 for securing the external cutter 64 to the drive shaft 20. Other embodiments of the pump 10 include alternative features for securing the external cutter 64 to the drive shaft 20 (e.g, a spline). The external cutter 64 and the impeller 34 are axially constrained to the drive shaft 20 by an end plate 78, which is secured to a distal end of the drive shaft 20 by a fastener.

Figure 3:
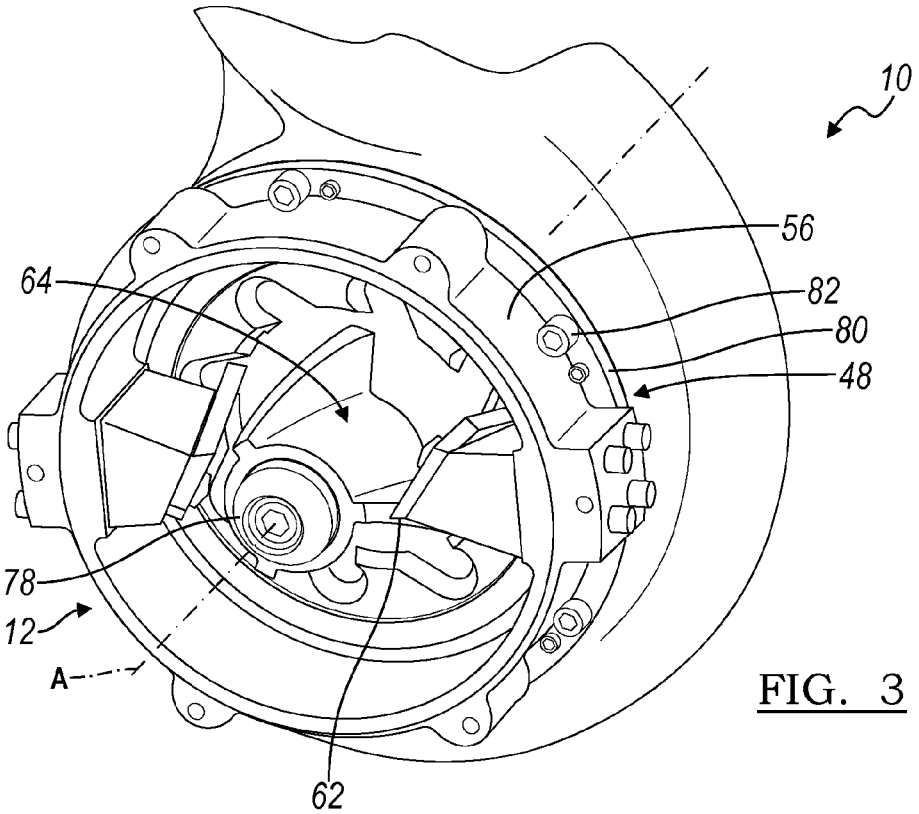
FIG. 3 is a side perspective view of the chopper pump of FIG. 1.
Figure 8:
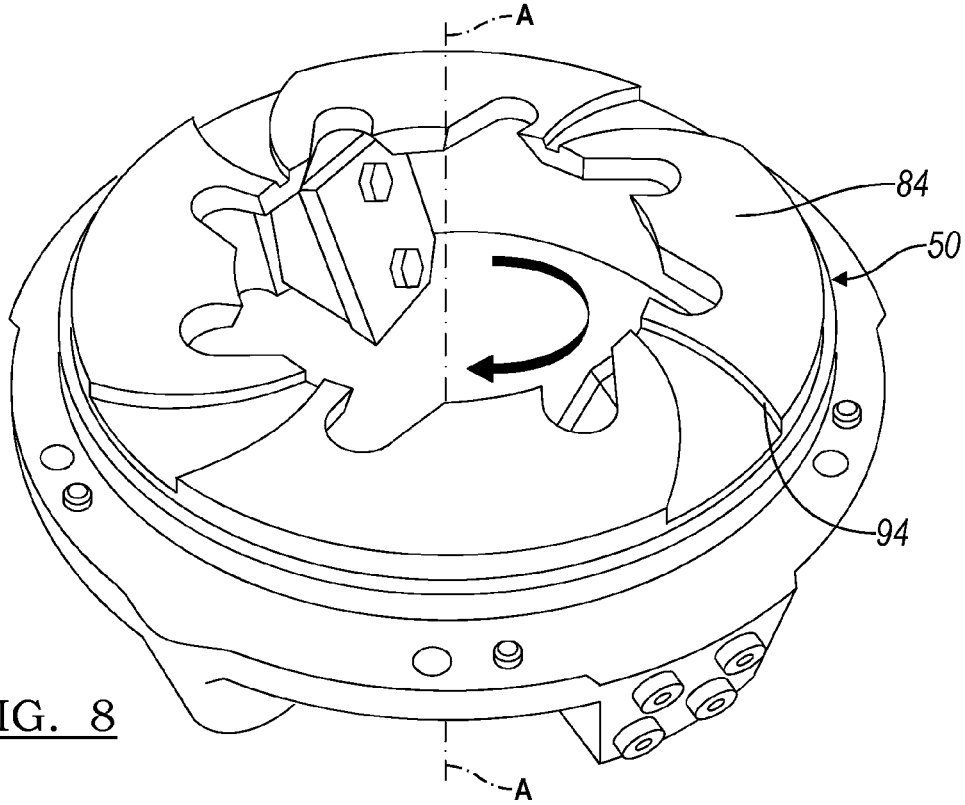
FIG. 8 is a side perspective view of an inner surface of the cover plate assembly of FIG. 6.

With reference to FIG. 3, the cover plate assembly 48 is adjustable along longitudinal axis A-A. The cover plate assembly 48 includes a flange 80 that extends radially outward from the wall 56. A series of threaded holes are formed through the flange 80 and receive mounting bolts 82. The bolts 82 extend through the flange 80 to engage corresponding threaded holes (not shown) formed in the casing 24. The base 50 is offset inward from the flange 80 (as shown in FIG. 8) which allows for axial adjustment of the cover plate assembly 48 relative to the casing 24 without permitting fluid from leaking out of the bowl 26. The cover plate assembly 48 is adjustable to allow minimal clearance between the base 50 and the impeller 34. In one embodiment the cover plate assembly 48 is adjusted inward until the base contacts a top surface of the impeller 34, then backed off per a predetermined clearance for a specific application.

The end plate 78 is formed in a generally frusto-conical shape in the illustrated embodiment. This shape extends the overall conical shape of the external cutter 64, which guides solid material within the fluid away from the axis A-A, and toward the blades 62.

Figure 4:
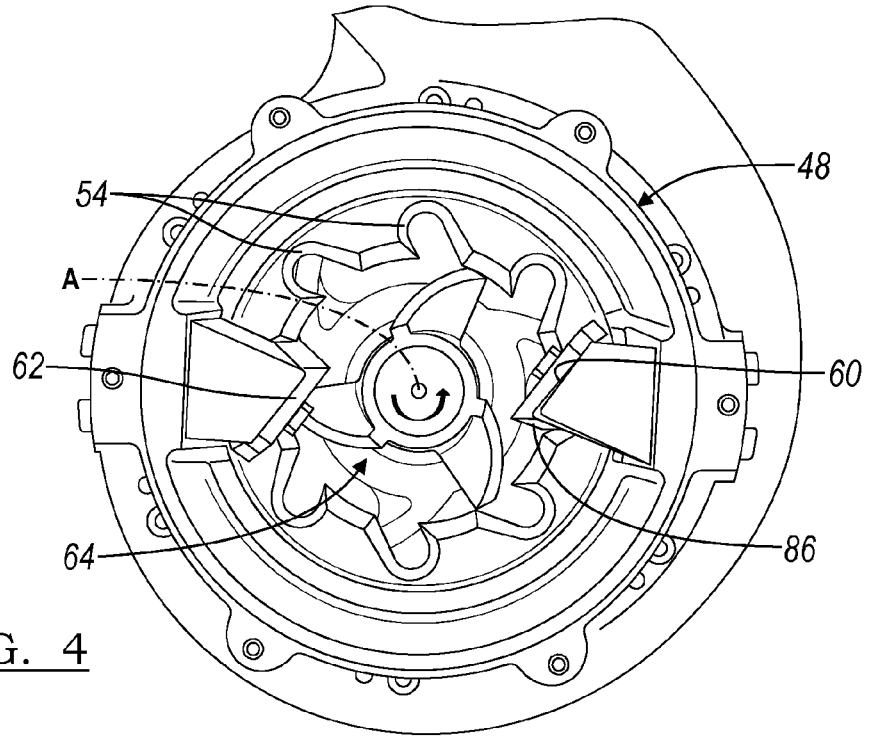
FIG. 4 is a side elevation view of the chopper pump of FIG. 1.

Referring to FIG. 4, the chopper pump 10 includes a plurality of blades, both stationary and rotating, to cut and macerate the waste fluid (solid material within the fluid). The chopper pump 10 includes three cutting stages: the first stage is an interface between the external cutter 64 and the stationary blades 62; the second stage is an interface between the external cutter 64 and the serrations 54; and a third stage is an interface between the impeller 34 and an inner surface 84 of the base 50 (shown in FIG. 8). The cutting interfaces at these three stages combine to provide at least forty two "chops" (cuts) per revolution of the drive shaft 20, to cut and macerate the waste material into a thick slurry. According to the illustrated embodiment, the drive shaft 20 rotates in a counter-clockwise direction about Axis A-A, as viewed in FIG. 4. In other embodiments, the drive shaft 20 may rotate in a clockwise direction.

Figure 5:
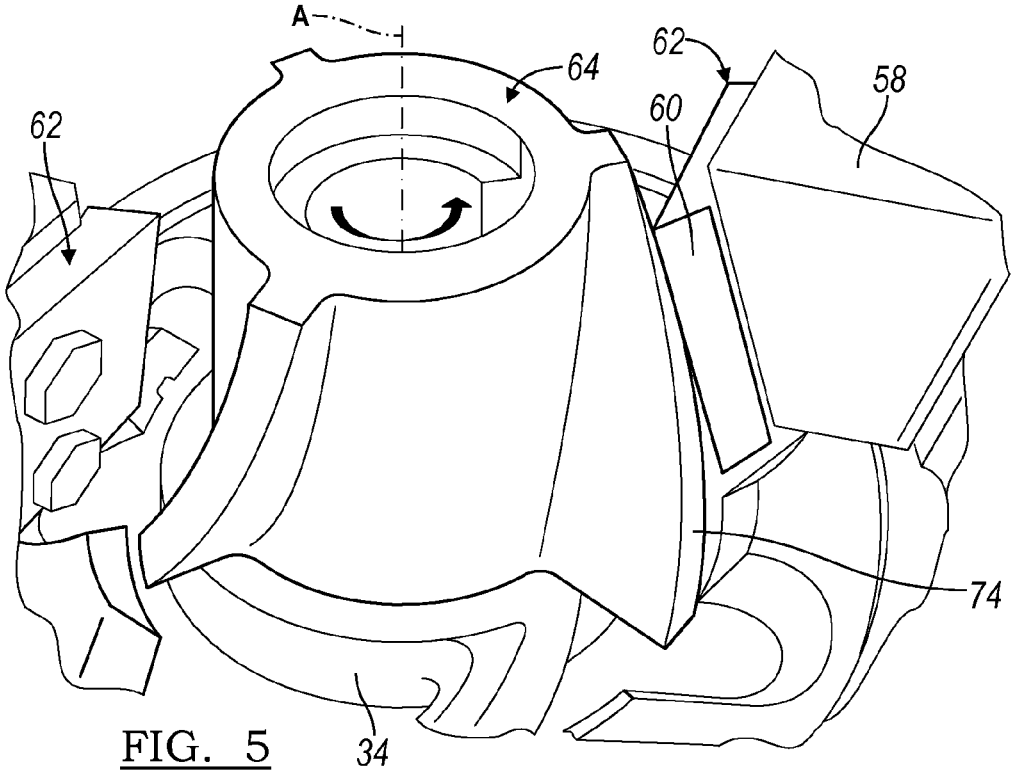
FIG. 5 is an enlarged side perspective view of an external cutter of the chopper pump of FIG. 1.

With reference to FIGS. 4 and 5, the first cutting stage that the waste fluid encounters as it enters the pump 10 is the interface between the three helical blades 74 of the external cutter 64 and the two blades 62 that are secured to the mounting blocks 58. The waste material is subjected to six "chops" (3×2) per revolution of the external cutter 64, as it passes through the first stage.

The mounting blocks 58 are positioned diametrically opposite each other about the wall 56 in the illustrated embodiment. Each blade 62 is secured to an inner face 60 of a mounting block 58. The inner faces 60 are oriented generally parallel to each other, and at an obtuse angle relative to a diametric imaginary line bisecting both mounting blocks 58. The shape of the inner faces 60 allows a cutting edge 86 of each blade 62 to be oriented axially adjacent to the longitudinal axis A-A.

The components of the chopper pump 10 may be serviced at periodic intervals, or fluid pressure upstream or downstream of the pump 10 may be monitored to determine service. The external cutter 64 (FIG. 5) is a replaceable component according to at least one embodiment. The cutter 64 may be formed of a hardened cast iron material. For example, in one embodiment the blades 62 are formed of hardened tool steel, having a Rockwell Hardness of RC62. The blades 62 may be formed of a harder material than the cutter 64, therefore the cutter 64 may wear first under normal operating conditions. The external cutter 64 may be removed and replaced by removing the end plate 78 (FIG. 3) and fastener, and sliding the cutter 64 axially away from the casing 24. Other embodiments of the chopper pump 10 include an impeller having an integrated external cutter (shown in FIG. 10) to cooperate with the cover plate assembly 48 for cutting and macerating waste material. For such an embodiment, the blades 62 are configured as a replaceable wear component, and are formed of a material that is less hard than the impeller.

Figure 6:
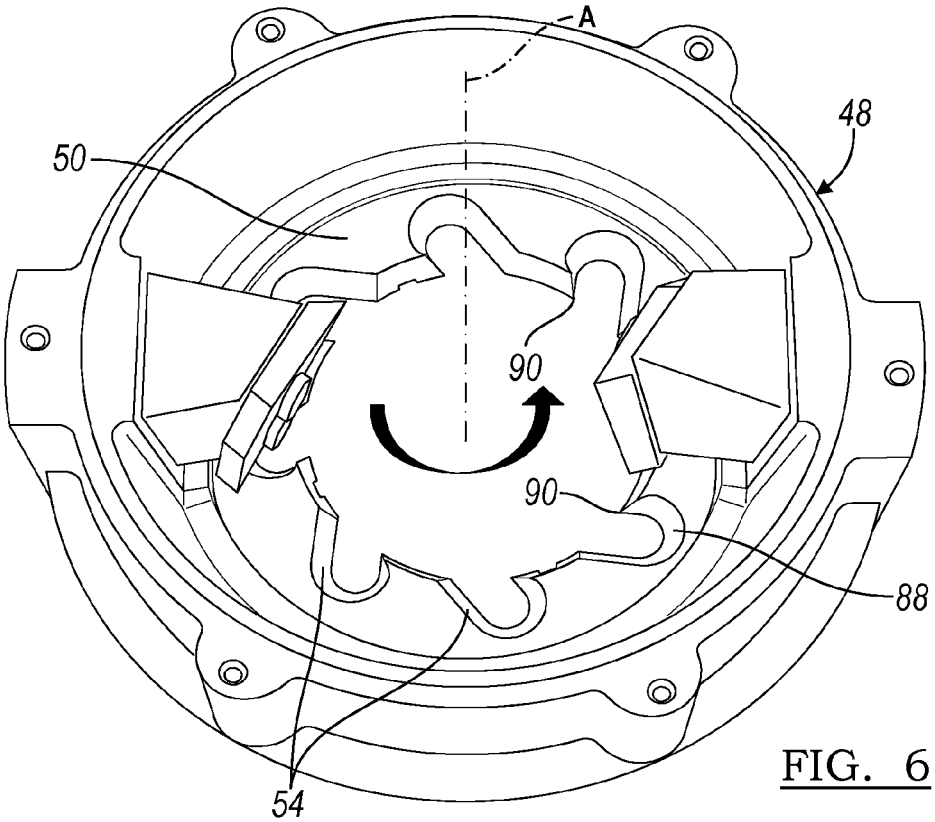
FIG. 6 is a side perspective view of a cover plate assembly of the chopper pump of FIG. 1.
Figure 7:
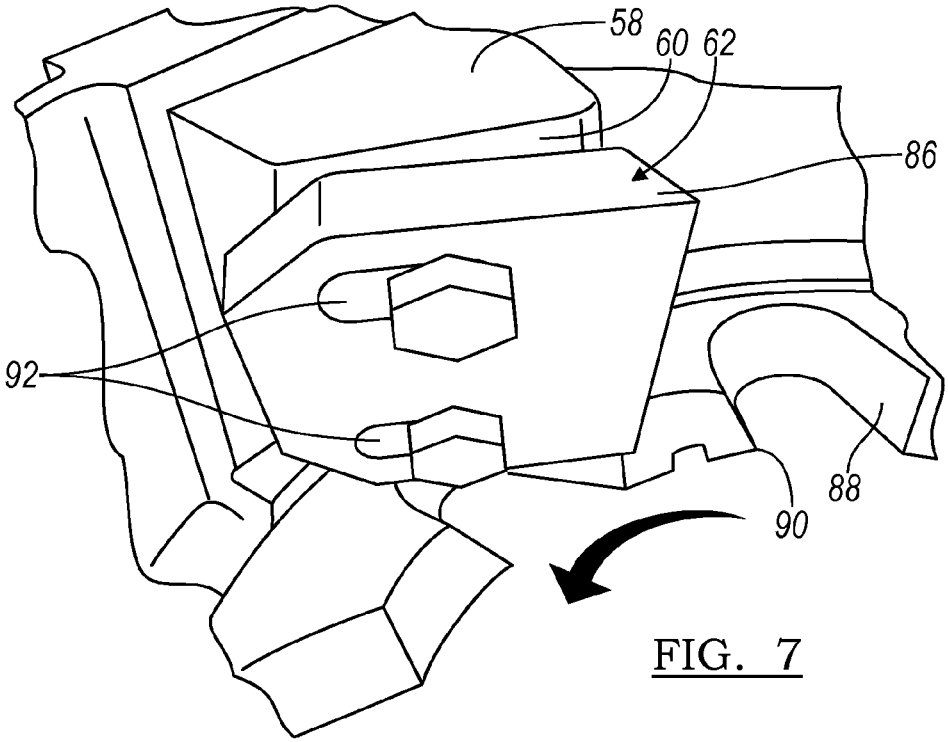
FIG. 7 is an enlarged side perspective view of a blade of the cover plate assembly of FIG. 6.

Referring to FIGS. 5-7, the second cutting stage is the interface between the three helical blades 74 of the external cutter 64 and the eight serrations 54 formed through the base 50 of the cover plate assembly 48. The waste material is subjected to twenty four "chops" (3×8) per revolution of the external cutter 64, as it passes through the second stage.

The position, shape and angularity of each serration 54 is configured to reduce energy consumption and to increase the overall efficiency of the chopper pump 10. The serrations 54 are angularly spaced apart about the central opening 52. Each serration 54 is formed into a curved pocket 88. Where each pocket 88 is tapered to form a sharp edge on the inner surface 84 of the base 50. Each pocket 88 is angled forward in the clockwise direction relative to axis A-A, as viewed in FIG. 4, to form a point 90 on a leading edge of each serration 54. The shape of each serration 54 allows for the solid material to be gradually sliced rather than abruptly sheared, which reduces energy consumption by the pump 10.

With respect to FIG. 7, the blade 62 is adjustable along the inner face 60 of the mounting block 58. Slots 92 are formed through each blade 62 for receiving fasteners for attaching the blade 62 to the mounting block 58, according to one or more embodiments. The slots 92 allow adjustment of the blade 62 along the inner face 60. This adjustment allows the cutting edge 86 of each blade 62 to be adjusted to a predetermined radial position for the application.

Figure 9:
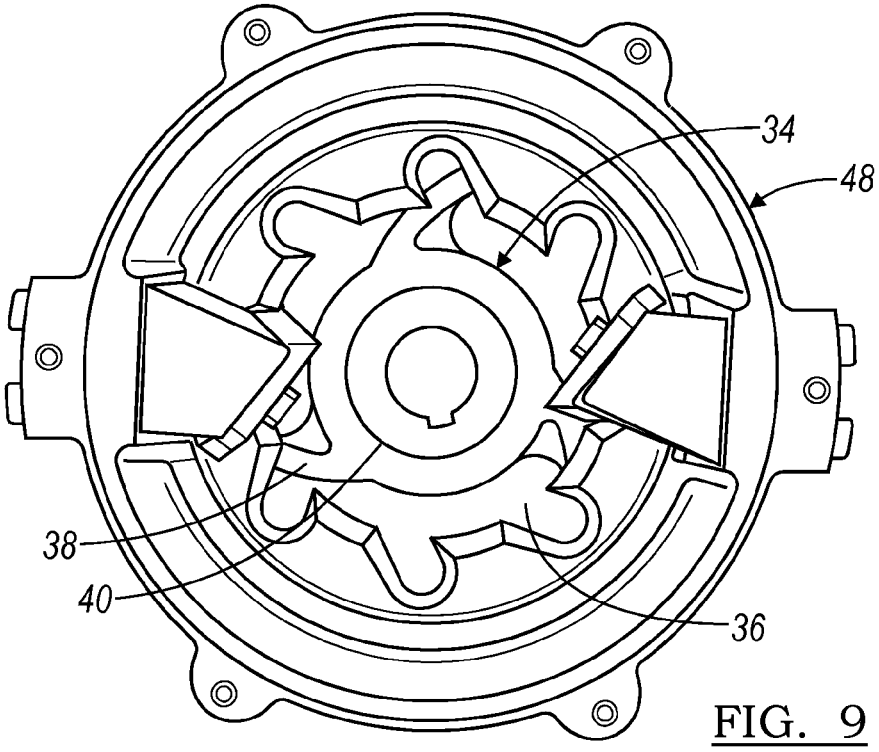
FIG. 9 is a side perspective view of the chopper pump of FIG. 1 illustrated without the external cutter, and a pump casing.

Referring to FIGS. 8 and 9, the third cutting stage is the interface between the three impeller vanes 38 and grooves 94 formed in the inner surface 84 of the base 50. The grooves 94 are formed in a curved shape that is swept rearward in the clockwise direction relative to axis A-A, as viewed in FIG. 8, and expand in thickness as the groove extends radially outward. The illustrated embodiment depicts four grooves 94 formed in the inner surface 84, with two serrations 54 between each groove 94. Therefore, the waste material is subjected to twelve "chops" (4×3 ) per revolution of the impeller 34, as it passes through the third stage. However, other embodiments of the cover plate assembly 48 include an equal number of grooves 94 as serrations 54 (e.g., eight serrations 54 and eight grooves 94). In yet other embodiments, two or more grooves 94 are formed in the inner surface 84 of the base 50.

FIG. 9 is a side perspective view of the chopper pump 10 without the external cutter 64. The cover plate assembly 48 encloses the impeller 34 within the casing 24. The vanes 38 of the impeller 34 extend outward in opposing directions from the central hub 40, and are generally swept back relative to the counter clockwise motion of the impeller 34. The vanes 38 are angularly spaced apart from each other about the plate 36.

Figure 10:
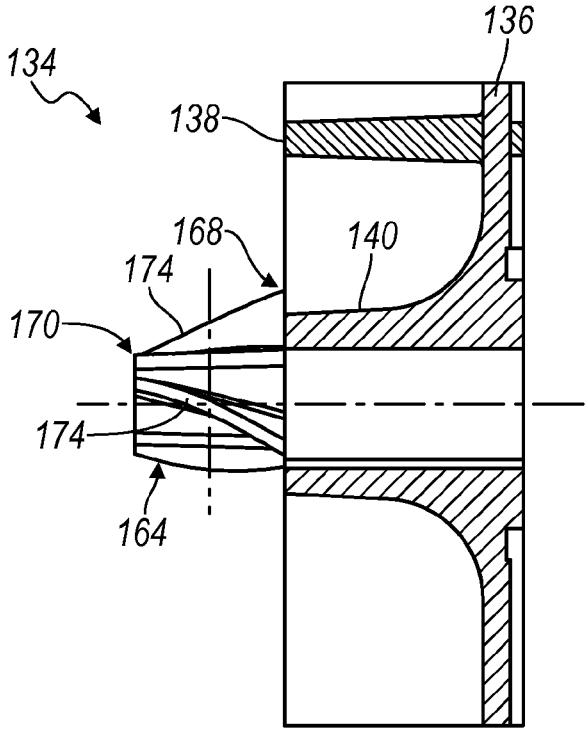
FIG. 10 is a side partial section view of an integrated impeller of the chopper pump of FIG. 1, according to one or more embodiments.

With reference to FIG. 10 an impeller having an integrated external cutter is illustrated according to one or more embodiments, and is referenced by numeral 134. The impeller 134 is formed in a semi-open configuration with a circular plate 136 and a series of vanes 138 that extend radially outward and are swept rearward relative to a direction of rotation of the impeller 134. The impeller 134 includes a central hub 140 that extends longitudinally from the circular plate 136.

The impeller 134 includes an integrally formed external cutter 164, or auger, that is formed at a distal end of the central hub 140. The external cutter 164 provides a rotating cutting mechanism. The cutter 164 includes a first end 168 and a second end 170 that is opposite to the first end 168. A plurality of helical blades 174 extend radially outward and are tapered such that a radial thickness of each blade 174 increases from the second end 170 to the first end 168 to form a generally frusto-conical shape. Such tapered blades 174 guide the waste material radially outward toward the stationary blades 62 and the serrations 54 of the cover plate assembly (shown in FIG. 9). For such an embodiment, the blades 62 are configured as a replaceable wear component, and are formed of a material that is less hard than the integrated impeller 134.

One aspect of the present invention is a chopper pump including a motor having a housing and a shaft extending from the housing along a longitudinal axis. The motor may be configured to provide output torque. The chopper pump may further include a casing coupled to the motor housing. The casing may have a bowl with an outlet tube extending tangentially therefrom. The bowl may define an inner cavity with a volute chamber projecting from the cavity and through the outlet tube. The bowl may have a central aperture for receiving the drive shaft, and an open end opposite the aperture defining an inlet. The chopper pump may further include an impeller disposed within the bowl. The impeller may be formed in a semi-open configuration with a circular plate and at least two curved vanes extending longitudinally from a face of the circular plate. The vanes may collectively form a central hub and extend generally radially outward in opposing directions from the hub toward an outer periphery of the plate. The vanes may be angularly spaced apart from each other about the plate. The impeller may have a central aperture projecting through the plate and the hub for receiving the drive shaft. The hub may have an inner surface adapted to engage the drive shaft for receiving the motor output torque. The chopper pump may include a cover plate assembly adjustably secured about the open end of the casing and enclosing the impeller within the casing. The cover plate assembly may include a base extending partially into the bowl with a central opening for receiving the drive shaft. The base may have a plurality of serrations formed therein, which may be angularly spaced about the central opening. The cover plate assembly may include a wall extending transversely from a circumferential edge of the base to define a recess. At least two mounting blocks extend radially inward from opposing surfaces of the wall. At least one blade may be mounted on the face of each of the at least two mounting blocks. Each blade may have an edge disposed axially adjacent to the longitudinal axis. Each blade may have at least one slot formed through for receiving a fastener for attaching the blade to the face of the mounting block. The slots may allow for adjustment of the blades along the face to adjust a radial position of the edge. The cover plate assembly may be adjusted longitudinally relative to the impeller for desired clearance between the blades and the impeller vanes. The chopper pump may further include a cutter having a cylindrical hub with a first end and a second end longitudinally opposite the first end with an aperture projecting axially through the hub for receiving the drive shaft. The first end may rest upon a top surface of the impeller vanes and extend longitudinally outward from the base of the cover plate assembly. The cylindrical hub may have an inner surface adapted to engage the drive shaft for receiving the motor output torque such that the cutter rotates with the drive shaft. The chopper pump may further include at least two helical blades that extend generally tangentially from the hub, wherein a radial thickness of each blade increases from the second end to the first end, to form a generally conical end.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A chopper pump comprising:

a motor having a drive shaft;

a casing connected to the motor and defining a bowl with an inlet for receiving waste material;

a cover plate assembly secured about the inlet, the cover plate assembly having a base with a central opening, and a plurality of serrations formed into the base and spaced about the central opening, each serration being formed into a curved pocket and longitudinally tapered to form an edge on an inner surface of the base that spans the entire central opening, and wherein at least two grooves are formed into the inner surface of the base, each groove expanding in thickness as it extends radially outward; and a cutter connected to the drive shaft and extending through the central opening of the base, the cutter having at least two blades extending radially outward to guide waste material toward the plurality of serrations.

2. The chopper pump of claim 1 wherein each curved pocket is angled forward relative to a direction of rotation of the drive shaft to form a point on a leading edge of each serration.

3. The chopper pump of claim 1 further comprising:

an impeller disposed within the bowl and connected to the drive shaft, the impeller having at least two vanes extending radially outward for converting motor torque into a centrifugal force;

a wall extending transversely from an outer edge of the base;

at least two mounting blocks extending radially inward from the wall; and a stationary blade mounted on each mounting block;

wherein the cutter extends through the central opening of the cover plate assembly, such that the blades of the cutter are oriented adjacent to the serrations and to each stationary blade.

4. The chopper pump of claim 3 wherein the blades of the cutter and the stationary blades of the cover plate assembly collectively provide a first cutting stage for cutting waste fluid as it enters the chopper pump.

5. The chopper pump of claim 3 wherein the blades of the cutter and the serrations of the cover plate assembly collectively provide a second cutting stage for cutting waste fluid as it passes through the central opening of the base.

6. The chopper pump of claim 3 wherein the vanes of the impeller and the grooves collectively provide a third cutting stage for cutting waste fluid within the bowl of the casing.

7. The chopper pump of claim 3 wherein the cover plate assembly is configured for longitudinal adjustment relative to the casing for adjusting a distance between the vanes of the impeller and the inner surface of the base.

8. The chopper pump of claim 3 wherein the cover plate assembly further comprises a flange extending radially outward from the wall, wherein a series of threaded holes are formed through the flange, and wherein threaded apertures are formed in the casing about the inlet, each threaded hole being aligned with one of the threaded apertures for receiving a mounting bolt, such that cover plate assembly is configured for longitudinal adjustment relative to the casing for adjusting a distance between the vanes of the impeller and the inner surface of the base.

9. The chopper pump of claim 3 wherein the stationary blades are formed of a harder material than the cutter, such that the cutter is configured to wear before the stationary blades.

10. The chopper pump of claim 3 further comprising an integrated impeller, the integrated impeller comprising the impeller and the cutter integrally formed out of a common material.

11. The chopper pump of claim 10 wherein the integrated impeller is formed of a harder material than the stationary blades, such that the stationary blades are configured to wear before the integrated impeller.

12. A chopper pump comprising:

a motor having a drive shaft;

a casing connected to the motor and defining a bowl with an inlet for receiving waste material;

a cover plate assembly secured about the inlet, the cover plate assembly having a base with a wall extending transversely from the base and at least two mounting blocks extending radially inward from the wall, each mounting block having a stationary blade mounted thereon; and a cutter having a hub connected to the drive shaft and at least two curved blades extending radially outward from the hub, the curved blades being longitudinally tapered to guide waste material radially outward from the drive shaft toward each stationary blade, and wherein the cutter further comprises an outer end oriented adjacent to the inlet, and an inner end opposite the outer end, and wherein the curved blades are longitudinally tapered such that a radial thickness of each blade increases from the outer end to the inner end.

13. The chopper pump of claim 12 wherein the cutter is formed in a generally frusto-conical shape.

14. The chopper pump of claim 12 wherein each stationary blade of the cover plate assembly includes a slot formed therethrough for receiving a fastener for attaching the blade to the corresponding mounting block, the slot facilitating adjustment of the stationary blade relative to the curved blades of the cutter.

15. The chopper pump of claim 12 wherein the stationary blades are formed of a harder material than the cutter, such that the cutter is configured to wear before the stationary blades.

16. The chopper pump of claim 12 wherein the base of the cover plate assembly is formed with a central opening and a plurality of serrations formed through the base and spaced about the central opening, each serration being formed into a curved pocket and angled forward to form a point on a leading edge of each serration.

* * * * *